United States Patent [19]

White

[11] Patent Number: 4,687,128

[45] Date of Patent: Aug. 18, 1987

[54] POINT-OF-PURCHASE DISPLAY

[75] Inventor: Roger L. White, Lawrence, Kans.

[73] Assignee: E and E Specialties, Inc., Lawrence, Kans.

[21] Appl. No.: 914,890

[22] Filed: Oct. 3, 1986

[51] Int. Cl.[4] ..... B65D 5/36

[52] U.S. Cl. ..... 229/41 R; 229/44 R; 206/44 R; 206/45.21

[58] Field of Search ..... 229/41 R, 41 B, 44 R; 206/44 R, 45, 45.14, 45.19, 45.21, 45.22, 45.24, 45.25, 45.26, 45.27

[56] References Cited

U.S. PATENT DOCUMENTS

| | | | |
|---|---|---|---|
| 2,314,424 | 3/1943 | Ringler | 206/44 R |
| 3,326,361 | 6/1967 | Zimmerman | 206/44 R |
| 4,138,012 | 2/1979 | Dutcher et al. | 229/41 B |
| 4,201,291 | 5/1980 | Davidson | 206/44 R |

*Primary Examiner*—Willis Little

*Attorney, Agent, or Firm*—Schmidt, Johnson, Hovey & Williams

[57] ABSTRACT

A corrugated board display structure has tabs for readily connecting a horizontally extending shelf to an upright support in such a manner that the load capacity of the shelf is significantly increased. Edge segments formed in an upright, folded portion of the shelf bear directly in end-to-end engagement with edge segments adjacent upstanding tabs of an upright support, and the depending tabs of the upright portion connected to the shelf are received behind the upstanding tabs of the upright support in order to thereafter retain the edge segments in continuous, flat contact. The longitudinal axes of the ridges and grooves of the corrugated panel forming the upright support are in generally parallel relationship to the longitudinal axes of ridges and grooves of the corrugated panel comprising the upright portion, so that the columnar strength presented by the corrugations of the support resist the load presented by the corrugated upright portion without bending of either corrugated panel in lateral directions. Preferably, an inclined, intermediate portion interconnects the shelf and the upright portion, and the shelf includes a bottom layer which extends beneath the intermediate portion and contacts the upright support to thereby present a horizontally extending, triangular beam which further enhances the load-bearing capacity of the display.

9 Claims, 7 Drawing Figures

POINT-OF-PURCHASE DISPLAY

BACKGROUND OF THE INVENTION

1. Field of the Invention

This invention relates to a knock down display structure die cut from corrugated board and foldable from an initially flat, collapsed orientation into an assembled configuration for use. More particularly, the invention concerns a means for connecting a shelf portion of the display to an upright, rear support by advantageously aligning the columnar strength presented the corrugated support with the columnar strength of an upright member portion which bears on an edge of the support and which sustains the shelf portion.

2. Description of the Prior Art

Display structures and racks formed from corrugated board are widely used in retail establishments for displaying merchandise in an attractive and eye-catching manner. Disposable displays formed from corrugated board are particularly advantageous in that each display can be custom-built to the proper dimensions for displaying the goods with a maximum exposure of each article and with a minimum of wasted rack space and corrugated board material. Moreover, the low cost of such displays allows the retailer to justify disposing of the structure once the goods are sold and the display is no longer needed.

Oftentimes, the manufacturer of goods will ship a display in a flat, knocked down configuration within a shipping carton that also includes the goods to be sold, primarily so that the display and the goods are conveniently kept together during shipping and storage until the time has arrived for assembling the display and offering the goods for sale. As a consequence, point-of-purchase displays are often assembled by relatively inexperienced store personnel, and therefore it is important to provide display structures that are easily assembled without utilizing components that would excessively increase the overall cost of the display.

In the majority of display structures, a shelf is provided for supporting the merchandise to be sold, and the shelf extends in a horizontal direction or in a direction slightly inclined in respect to horizontal. In some instances, the shelf is supported in an elevated position by an adjacent, upstanding rear panel or by two side panels of the structure. Occasionally, separate clips or fasteners are utilized to connect the shelf to upstanding panels, but more typically tabs extending integrally outwardly from the shelf are provided for reception into slots formed in the upstanding panels, in order to reduce the number of component parts and keep costs at a minimum.

In the past, known displays having shelves with tabs that connect to adjacent upright supports were often constructed in such a fashion that the tabs are relatively short and were intended to remain in a horizontal orientation co-planar with the major regions of the shelf. In other cases, however, the tabs of such shelves were of a somewhat longer length so that each tab could be inserted through a slot in the upright panels, bent at a 90-degree angle, and inserted through a second slot in the panel in an opposite direction.

Unfortunately, horizontally extending tabs which are received in slots of adjacent upright panels and which are relied upon to provide support for a shelf often collapse and fail unless the articles placed upon the shelf are collectively relatively light in weight. Failure of the tabs is due primarily to the structural configuration of the corrugated board which, in many cases, comprises two flat face sheets interconnected by an intermediate corrugated panel. Boards of this type are commonly manufactured from paper or paper composites and thus the beams or columns formed by the alternating series of ridges and grooves of the corrugated panel in combination with the two flat face sheets have a relatively low resistance to bending in directions transverse to the longitudinal axes of the ridges and grooves and the planes of the respective face sheets.

As a result, when corrugated display structures are constructed having a shelf with integral, horizontal tabs received in horizontal slots of an upright support panel, goods placed on the shelf often cause the corrugated tabs to bend, even when the longitudinal axes of the ridges and grooves of the tabs are oriented in a horizontal direction perpendicular to the upright support panels and the slots formed therein. In order to overcome this problem, extra support members may be placed underneath the shelf or other types of fasteners may be utilized in conjunction with the tabs, but both of these solutions unacceptably increase the overall cost of the display which is in reality intended to be disposable and therefore relatively low in cost.

SUMMARY OF THE INVENTION

The present invention overcomes the disadvantages described above by provision of a means for interconnecting a shelf with an adjacent, upright panel or support in such a manner that the load capability or rating of the shelf is significantly increased. The display can be easily assembled from the front thereof within a short period of time, yet is rigidly interlocked once assembled so that the probability of unintentional disjointing and collapse of the display structure is minimized.

More particularly, I provide a corrugated board display having a panel member which is folded to present a horizontal shelf portion, an adjacent intermediate portion disposed at an angle to the shelf portion and an upright portion adjacent the intermediate portion. Two depending tabs integrally formed as part of the upright portion are received behind two upstanding tabs which represent part of an adjacent, upright rear support that is in generally parallel, face-to-face relationship with the upright portion of the member.

The rear support is cut on both sides of the two upstanding tabs to present four horizontally extending edge segments located at the base of the tabs. Additionally, the upright portion of the member is cut to present four horizontally extending edge segments located on opposite sides of the head of each depending tab. The longitudinal axes of the corrugated ridges and grooves of both the upright portion and the rear support extend in vertical directions, so that the four edge segments formed in the upright portion and the four edge segments formed in the rear support extend transversely to the longitudinal axes of the adjacent, corrugated board ridges and grooves and the columns formed thereby.

Once the depending tabs of the upright member portion are inserted behind the upstanding tabs of the rear support, each edge segment of the upright portion is disposed above a corresponding one of the edge segments of the support and directly bears against the same. Consequently, the columnar configurations presented by the ridges and grooves of the upright member portion are aligned in generally parallel, end-to-end, abutting relationship with the columns presented by the underlying ridges and grooves of the upright support so that the strength of the interconnection between the upright member portion and the rear support is enhanced. That is, because the columns of corrugations of the upright member portion bear in end-to-end relationship with underlying corrugation columns of the rear upright support, the corrugations of either the member or the support are not subject to bending loads in transverse directions and instead the strength of the interconnection is, for the most part, limited to the relatively large compression limit of the columns that is derived by loading the corrugated boards in directions parallel to the longitudinal axes of the ridges and grooves.

Thus, the load bearing capability of the shelf is substantially increased thereby enabling relatively lightweight corrugated board panels to be utilized without fear of collapse of the shelf. In addition, reception of the tabs of the upright member portion behind the upstanding tabs of the rear support ensures that the four edges segments of the upright member portion remain in continuous contact with corresponding edge segments of the support and not deflect laterally to a position wherein the edge segments disengage each other.

DETAILED DESCRIPTION OF THE DRAWINGS

Figure 1:
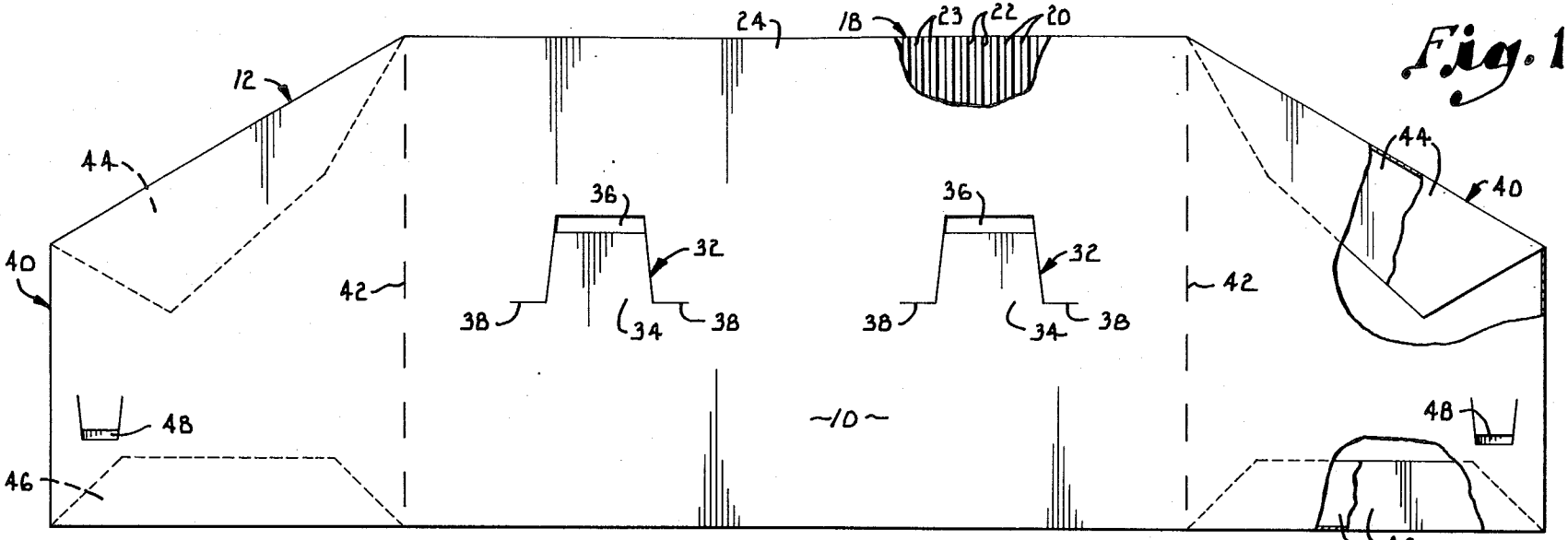
FIG. 1 is a front elevational view of a rear support of the display of the present invention, depicting the support in a flat configuration prior to folding thereof for assembly of the display.
Figure 2:
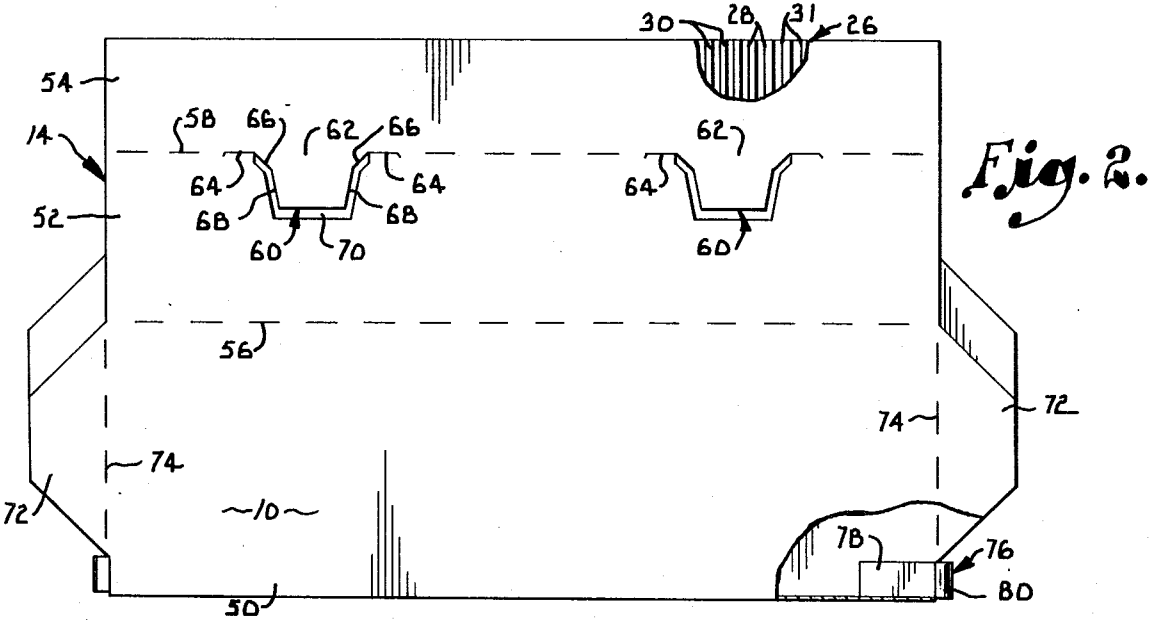
FIG. 2 is a plan view of a shelf member of the present invention shown in a flat configuration before the member is folded to assemble the display.
Figure 3:
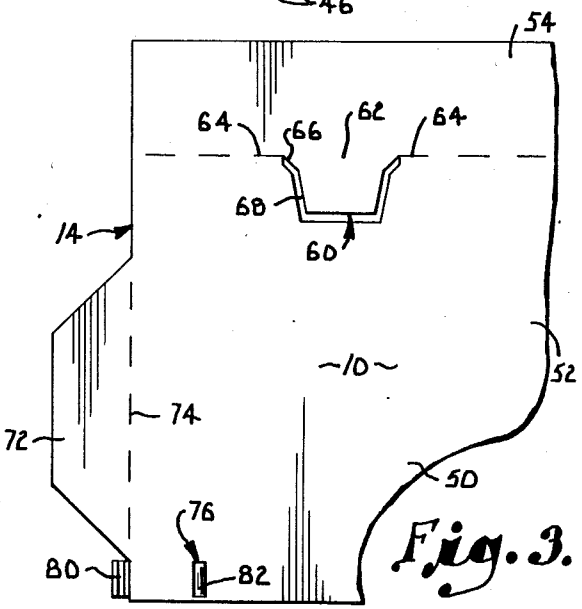
FIG. 3 is a fragmentary, bottom of view of one side of the member shown in FIG. 2.
Figure 7:
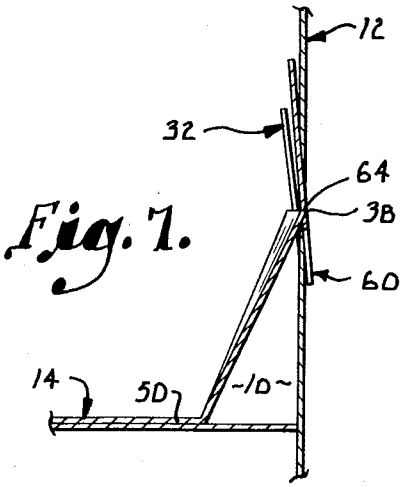
FIG. 7 is a fragementary, side cross-sectional view taken along line 7—7 of FIG. 4, showing in greater detail the orientation of the tabs of the support and of the upright member portion.
Figure 4:
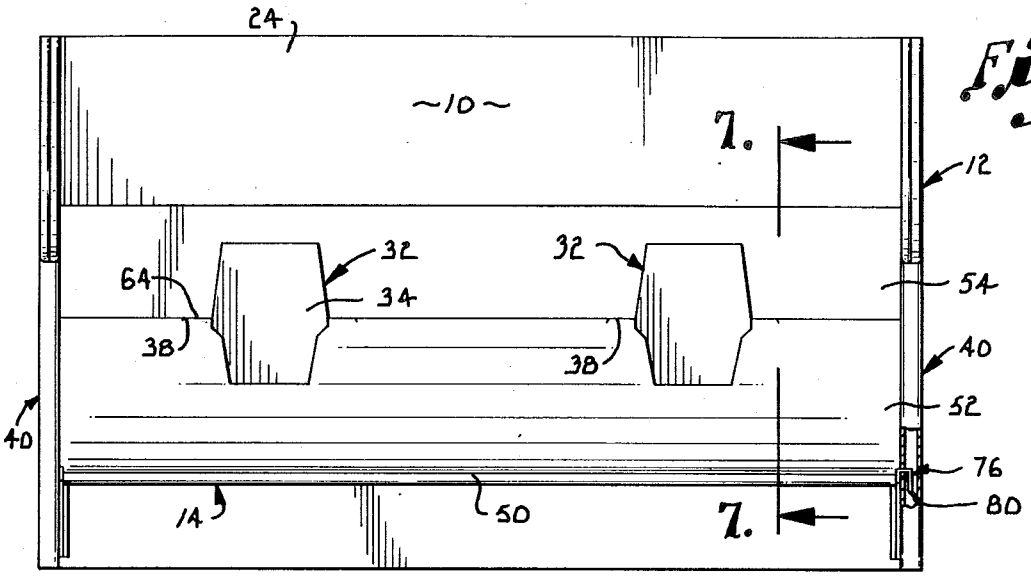
FIG. 4 is a front elevational view of the assembled display of the present invention, illustrating an upright portion of the member which receives two upstanding tabs of the rear support.
Figure 5:
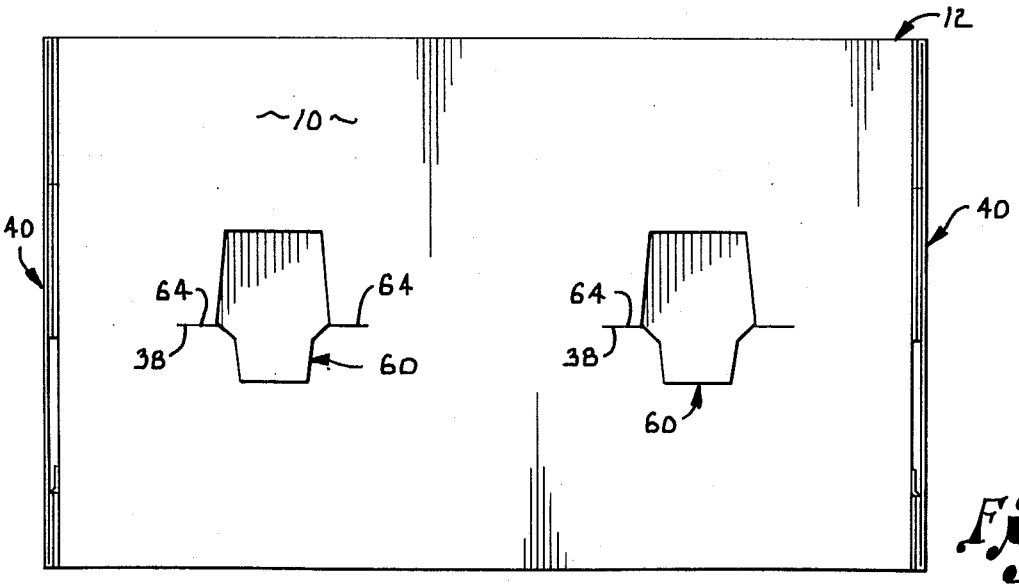
FIG. 5 is a rear elevational view of the assembled display structure shown in FIG. 4, depicting two depending tabs of the upright member portion that are received behind the upstanding tabs of the support.

A display or display structure 10 is shown in its assembled configuration in FIGS. 4, 5 and 7 and includes an upright support 12 that is shown individually in FIG. 1 and a shelf member or member 14 which is depicted individually in FIGS. 2 and 3. As shown in FIG. 1, the support 12 is comprised of a corrugated board material which includes a spaced pair of upright, flat sheets 16, 16 and a corrugated panel 18 interconnecting the sheets 16, 16. The corrugated panel 18 presents an alternating series of elongated ridges 20 and elongated grooves 22 that are parallel to ridges 20, and the ridges 20 and grooves 22 are fixed to inner surfaces of a respective one of the flat sheets 16, 16.

Similarly, member 14 is also formed from a corrugated board and, as shown in FIG. 2, includes a pair of spaced, generally flat sheets 24, and a corrugated panel 26 interconnecting the flat sheets 24, 24. The panel 26 presents an alternating series of elongated ridges 28 and elongated grooves 30 which are parallel to the ridges 28, and the ridges 28 and grooves 30 are fixed to inner surfaces of a respective one of the flat sheets 24, 24.

The structural nature of the corrugated member 14 is such that the ridges 28 and grooves 30, in combination with adjacent sheets 24, combine to form columns 31 in directions parallel to the longitudinal axes of the ridges 28 and grooves 30. As a consequence, the member 14 can resist relatively large compressive loadings in directions parallel to the ridges 28 and the grooves 30 in comparison to the load capabilites of member 14 in lateral directions transverse to the sheets 24. In similar fashion, columns 23 formed by the ridges 20, grooves 22 and sheets 16 of the support 12 resist substantial longitudinal compressive loads in comparison to lateral loads directed to the support 12 in a direction perpendicular to the sheets 16.

As shown in FIG. 1, the support 12 is formed, such as a by a die cutting operation, to present two flat, upstanding tabs 32 integral with the support 12 and having a trapezoidal configuration. Each of the tabs 32 presents a base 34 and optionally the upper edge of each tab 32 is removed to form a slot 36. A horizontal cut is made in the support 12 on each side of each tab 32 adjacent the base 34 of the same to present four edge segments 38 which extend horizontally in transverse relationship to the longitudinal axes of the ridges 20 and of the grooves 22.

Again referring to FIG. 1, the support 12 has two sides 40 formed by folding the support 12 along the dashed lines indicated at 42. Each of the sides 40 is of double wall thickness and is formed by fixing an upper, folded downwardly flange 44 and a lower, folded upwardly flange 46 of the one wall to similar flanges 44, 46 of the adjacent, side-by-side wall. The inner wall of each side 40 is also provided with an opening 48 for purposes to be explained hereinafter.

With reference to FIGS. 2–4 and 7, the member 14 has a shelf portion 50, an intermediate portion 52 and an upper or upright portion 54. During assembly of the display 10, the member 14 is folded along dashed lines indicated at 56, 58 in FIG. 2 to the configuration best appreciated with reference to FIG. 7, so that the flat shelf portion 50 extends in a generally horizontal direction and the flat upright portion 54 is approximately parallel to the vertical rear support 12. The flat intermediate portion 52 interconnects the shelf portion 50 and the upright portion 54 and extends at an angle relative to both of the portions 50, 54.

As illustrated in FIGS. 2 and 3, the upright portion 54 of member 14 includes two integrally connected, depending tabs 60 having a flat, generally trapezoidal configuration and a head 62 aligned with fold line 58. Additionally, the member 14 is cut to present an edge segment 64 extendng horizontally from each side of each tab 60 adjacent respective heads 62. Consequently, the edge segments 64 are disposed in transverse relationship of the longitudinal axes of the ridges 28 and the grooves 30 of member 14.

Each of the tabs 60 of member 14 are formed to present relatively short chamfered edges 66 intermediate adjacent horizontal edge segments 64 and generally vertical sides 68. Furthermore, the member 14 is cut a slight distance away from the edges defining the tabs 60 to define a generally trapeziodal opening 70 that is complimental in configuration to the formed perimeter of tab 60.

From comparison of FIGS. 2, 3 and 7, it can be seen that the shelf portion 50 of member 14 is formed by a double layer of corrugated board, the bottom layer of which extends below part of the intermediate portion 52 in spaced relation to the same. Each layer of the shelf portion 50 is integrally connected to trapezoidally-shaped sides 72 that are folded along the dashed lines indicated at 74 during the final assembly of the display 10.

Finally, a clip 76, as depicted in FIGS. 2 and 3, is mounted between the double layers of corrugated board comprising the shelf portion 50 adjacent each front corner of the latter and in front of sides 72. The clip 76 has an elongated arm 78 received between the layers forming the shelf portion 50, and U-shaped segment 80 fixed to the arm 78 that extends outwardly past the perimeter of shelf portion 50. As shown in FIG. 3 the elongated arm 78 is provided on one side with a protuberance 82 that extends through a notched hole in one layer of the corrugated board forming the shelf portion 50 in order to securely lock the clip 56 in position once the two layers of the shelf portion 50 are fixed together by an adhesive or the like.

During manufacture of the display 10, flanges 44, 46 of each side 40 of the support 12 are interconnected preferably by an adhesive, and likewise as stated above the double layers of corrugated board forming the shelf portion 50 are fixed together once the clip 76 is installed in place. The support 12 and the member 14 are then shipped to the retailer or route salesperson who folds and assembles the display 10 to prepare the latter for use.

More particularly, assembly of the display 10 is readily accomplished by folding the sides 40, 40 of support 12 along dashed lines indicated at 42 until the sides 40, 40 are approximately 90-degrees from the rear panel of support 12.

Figure 6:
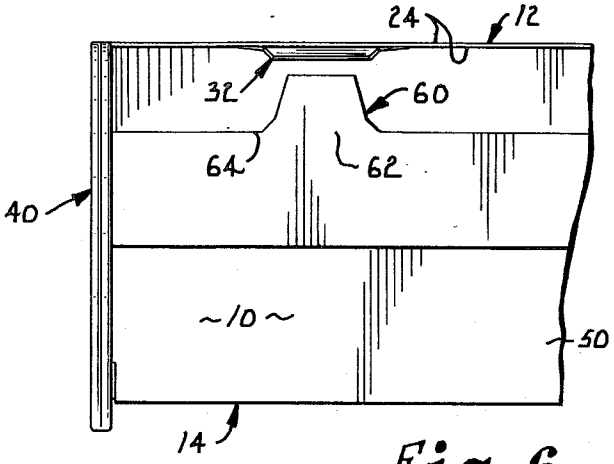
FIG. 6 is a fragmentary, plan view of the display structure of the present invention during assembly thereof and immediately prior to insertion of the tabs of the upright member portion behind the upstanding tabs of the rear support.

Next, sides 72, 72 of member 14 are folded downwardly approximately 90-degrees from the shelf portion 50 and U-shaped segments 80 of both clips 76 are inserted within respective openings 48 of the support 12. Intermediate portion 52 is then bent upwardly and the upright portion 54 is bent to approximately a horizontal orientation as shown in FIG. 6 so that the two tabs 60 of member 14 can be horizontally received within the slots 36 above tabs 32 of support 12.

Next, the upright portion 56 is pivoted about the top of the tabs 32 and the tabs 60 are guided downwardly behind the tabs 32 while the tabs 32 deflect laterally toward the front of the display 10 to enable the tabs 60 to be received therebehind. Upright portion 54 is then further guided downwardly until the four downwardly facing edge segments 64 of member 14 flatly contact the four upwardly facing edge segments of support 12 respectively. At this time, assembly of the display is complete and the merchandise to be sold can now be placed upon shelf portion 50.

As can now be appreciated, the location of the edge segments 64 in overlying, direct abutting contact with a respective one of the four edge segments 38 enables the columnar, load-bearing strength presented by the corrugated panel 18 and sheets 16 of support 12 to be generally aligned with the columnar, load-bearing strength presented by the corrugated panel 26 and sheets 24 of support 12, as is perhaps understood by reference to FIG. 7. Therefore, since the columnar strength presented by edge segments 38 of support 12 can withstand relatively large loads presented by adjacent edge segments 64 of upright portion 54, the shelf portion 50 in turn can support a variety of goods or merchandise having a relatively large collective weight. Moreover, since the upright portion 54 is approximately parallel to the rear support 12, and is maintained in such a position by provision of tabs 32, upright portion 54 including tabs 60 substantially do not bend or collapse under loadings in contrast to the prior art displays having tabs extending horizontally from a shelf and which often buckle downwardly in a direction perpendicular to the longitudial axes of the corrugations.

Furthermore, provision of the tabs 32, 60 cause edge segments 38, 64 to be deflected laterally somewhat from the plane of the major regions of the support 12 and the upright portion 54 respectively to enable the edge segments 38, 64 to be located in interior regions spaced from the perimeter of the support 12 and the upright portion 54 regardless of the fact that the edge segments 64 of upright portion 54 directly bear against edge segments 38 of support 12. The inherent resiliency of the tabs 32, 60 assist in retaining the display 10 in an assembled configuration although collapse of the display 10 can be readily accomplished by lifting the upright portion 54 until tabs 60 clear slots 36.

Moreover, the intermediate portion 54 facilitates distribution of stresses within member 14 by spreading the load on shelf portion 54 over the entire length of the fold line 56 between intermediate portion 52 and shelf portion 50 before the same load is distributed to upright portion 54. Noteworthy also is the fact that the lower layer of the shelf portion 50, as shown in FIG. 7, bears against a lower region of the support 12 below intermediate portion 54 to thereby form a triangular, horizontally extending beam comprising a portion of the upright support 12, the intermediate portion 52 and part of the lower layer of shelf portion 50. Such construction increases the load rating of shelf portion 50 by reducing the amount of force that would otherwise be directed entirely to the four edge segments 38 of support 12 and is preferred over an assembly having a horizontal shelf that is connected to an upright portion at a 90-degree angle where the upright portion has depending tabs received in slots of an adjacent upright support.

I claim:

1. A display comprising:

an upright, corrugated board support having a spaced pair of upright, generally flat sheets and a corrugated panel interconnecting said sheets, said corrugated panel having an alternating series of elongated ridges and elongated grooves with the longitudinal axes of said ridges and grooves being oriented in an upright direction, said sheets and said ridges and grooves of said support thereby presenting a series of elongated, upright columns;

a member formed from corrugated board having a pair of spaced, generally flat sheets and a corrugated panel interconnecting said sheets of said member, said corrugated panel of said member having an alternating series of elongated ridges and elongated grooves, said sheets of said member and said ridges and grooves of said member thereby presenting a series of elongated columns, said member having a shelf portion extending in a generally horizontal direction for supporting articles to be displayed; and means connecting said shelf portion of said member to said upright support and for enhancing the load carrying capacity of said shelf portion, said means including:

an edge segment formed in said support and extending in a generally horizontal direction in transverse relationship to the longitudinal axes of said column of said support;

an upright portion of said member connected to said shelf portion and disposed in generally parallel, side-by-side relation to said upright support, the longitudinal axes of said columns of said upright portion being oriented in an upright direction, and an edge segment formed in said upright portion and extending in a generally horizontal direction in transverse relationhip to the longitudinal axes of said columns of said upright portion, said edge segment of said upright portion of said member being disposed above said edge segment of said support and directly bearing on said edge segment of said support such that the columns presented by said corrugated board upright portion are in generally parallel, end-to-end, abutting relationship with the columns presented by said upright support whereby the load strength of said connecting means is generally limited only by the longitudinal compressive limit of the columns of said upright portion and said support and lateral bending failure of the columns is substantially precluded.

2. The invention as set forth in claim 1, wherein said means connecting said shelf portion to said support includes means for laterally deflecting a portion of at least one of said upright portion and said support adjacent said edge segment of said upright portion and said support respectively to enable said edge segments to be located in interior regions in spaced relation to the perimeter of said upright portion and said support respectively regardless of the fact that said edge segment of said upright portion bears directly upon said edge segment of said support.

3. The invention as set forth in claim 2, wherein said support includes an upstanding tab having a base and said edge segment of said support extends horizontally from said base of said tab.

4. The invention as set forth in claim 2, wherein said upright portion includes a depending tab having a head, and said edge segment of said support extends horizontally from said head.

5. The invention as set forth in claim 2, wherein said support includes an upstanding tab having a base, said upright portion includes a depending tab having a head, said edge segment of said support extends horizontally from one side of said base, and said edge segment of said upright portion extends horizontally from one side of said head; and including a second edge segment of said support extending horizontally from said base on the opposite side of said tab of said support; and a second edge segment of said upright portion extending horizontally from said head on the opposite side of said tab of said upright portion, said second edge segment of said upright portion bearing directly on said second edge segment of said support.

6. The invention as set forth in claim 5, wherein said tab of said support and said tab of said upright portion each have a generally trapezoidal configuration.

7. The invention as set forth in claim 6, wherein said tabs of said support and said tab of said upright portion are integral with said support and said upright portion respectively.

8. The invention as set forth in claim 1, wherein said member integrally includes a generally flat, intermediate portion interconnecting said shelf portion and said upright portion and said intermediate portion is disposed at an angle to said shelf portion and said upright portion.

9. The invention as set forth in claim 1, wherein said shelf portion engages said upright support below said intermediate portion to thereby provide a triangular, generally horizontal beam bounded by a part of said support, said intermediate portion, and a part of said shelf portion.

* * * * *